US005699844A

United States Patent [19]

Witt

[11] Patent Number: 5,699,844

[45] Date of Patent: Dec. 23, 1997

[54] ROUTER PLATE WITH REMOVABLE INSERTS

[76] Inventor: Bradley R. Witt, 5323 W. Kimberly Rd., Davenport, Iowa 52806

[21] Appl. No.: 734,585

[22] Filed: Oct. 22, 1996

[51] Int. Cl.[6] ..... B27M 1/00; B27C 5/00; B21D 39/00

[52] U.S. Cl. ..... 144/329; 29/428; 29/522.1; 144/135.2; 144/136.95; 144/134.1

[58] Field of Search ..... 144/134.1, 135.2, 144/134.95, 154.5, 371, 329; 29/428, 451, 522.1; 409/84, 131, 181, 182

[56] References Cited

U.S. PATENT DOCUMENTS

| | | | |
|---|---|---|---|
| D. 277,287 | 1/1985 | Baer | D15/124 |
| D. 284,735 | 7/1986 | Olson et al. | D8/61 |
| D. 301,926 | 6/1989 | Weissman | D24/10 |
| D. 323,331 | 1/1992 | Wang | D15/125 |
| D. 345,366 | 3/1994 | Hewitt | D15/125 |
| D. 349,292 | 8/1994 | Chunn | D15/125 |
| D. 351,774 | 10/1994 | Witt | D8/71 |
| D. 353,149 | 12/1994 | Hewitt | D15/125 |
| 3,734,151 | 5/1973 | Skripsky | 144/1.1 |
| 4,294,297 | 10/1981 | Kieffer | 144/154.5 |
| 4,875,513 | 10/1989 | Skarsten | 144/286.1 |
| 5,025,841 | 6/1991 | Totten | 144/82 |
| 5,080,152 | 1/1992 | Collins et al. | 144/134.1 |
| 5,289,861 | 3/1994 | Hedrick | 144/83 |
| 5,398,740 | 3/1995 | Miller | 144/286.1 |

OTHER PUBLICATIONS

Woodhaven Catalog entitled *Uncommon Woodworking Tools*, 1995, Woodhaven, Inc. pp. 3, 5, 10–13.

*Primary Examiner*—W. Donald Bray

*Attorney, Agent, or Firm*—Zarley, McKee, Thomte, Voorhees, & Sease

[57] ABSTRACT

A router plate for use with a router having a planar surface and an arbor projecting therethrough. The router plate comprises a flat plate member having an opening extending therethrough with a rabbet flange extending inwardly from the outer perimetric edges of the opening. The invention also includes a removable insert that resides within the opening in the router plate and is supported by the rabbet flange. A plurality of removable inserts may be provided, each having a differently sized aperture for accepting a particular router bit. The insert appropriately sized for a particular application is detachably mounted to the router plate.

12 Claims, 3 Drawing Sheets

ROUTER PLATE WITH REMOVABLE INSERTS

FIELD OF THE INVENTION

The present invention relates to routers and, in particular, to a router plate with removable inserts.

BACKGROUND OF THE INVENTION

The use of routers and router plates in woodworking applications and the like is well known. A router plate provides a planar surface for supporting a work piece. The router plate is typically mounted atop the router and has an aperture aligned with an arbor on the router to allow a router bit to be projected therethrough to cut and detail the work piece.

Although prior art router plates have several desirable features, they also have some inherent problems. First, most router plates have only one bit opening. A router is normally designed, however, for use with router bits of different size. Thus, to accommodate a variety of different bits, several router plates are required. Router plates are expensive and installing them is time-consuming. Thus, there is a need in the art for a router plate that is easily adaptable for use with router bits of different size.

Prior art attempts to solve this problem have proved unsuccessful. Prior art inserts and other articles used to transform the router plate are either poorly secured to the router plate or cannot easily be inserted and removed without the use of tools.

It can therefore be seen that there is a real and continuing need for the development of an improved router plate that can be used with a variety of different router bits.

The primary objective of the present invention is the provision of a router plate which is efficient in operation, economical to manufacture, and durable in use.

Another objective of the present invention is the provision of a router plate that is easily adaptable for use with a variety of different router bits.

Another objective of the present invention is the provision of a plurality of removable inserts that can be easily mounted to a router plate and are interchangeable for use with a variety of different router bits.

Still another objective of the present invention is the provision of a removable insert that can be detachably secured to a router plate without the use of tools.

Another objective of the present invention is the provision of an improved method for detachably securing a removable insert to a router plate.

SUMMARY OF THE INVENTION

The foregoing objectives are achieved in a preferred embodiment of the invention by a router plate comprising a flat plate member having an opening extending therethrough, the opening having a rabbet flange extending inwardly from its outer perimetric edges. In its preferred form, the opening is circular and has an elastomeric 0-ring disposed about its outer perimetric edge.

A removable insert is disposed within the opening in the flat plate member, the insert being supported by the rabbet flange and having a groove about its side edge for receiving the elastomeric O-ring in the flat plate member. The invention is intended for use with a plurality of removable inserts, each having a differently sized aperture extending therethrough, to enable the router plate to fit a variety of router bit sizes.

DETAILED DESCRIPTION OF THE INVENTION

The present invention will be described as it applies to its preferred embodiment. It is not intended that the present invention be limited to the described embodiment. It is intended that the invention cover all alternatives, modifications, and equivalents which may be included within the spirit and scope of the invention.

Figure 1:
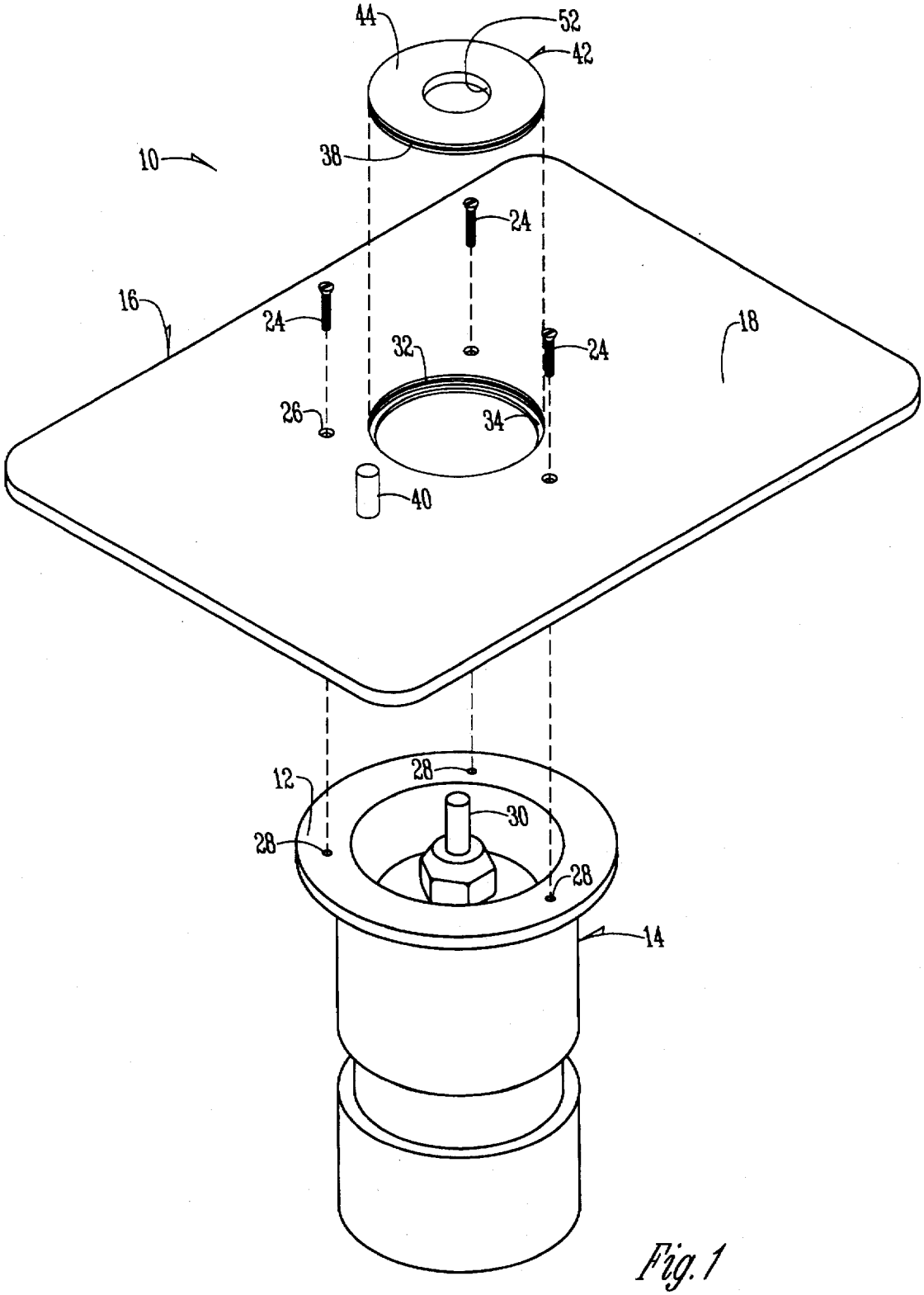
FIG. 1 is an exploded perspective view of the router plate and insert of the present invention shown with a vertically mounted router.

With continuing reference to the drawings, the router plate 10 of the present invention may be mounted to a planar mounting surface 12 of a router 14 as shown in FIG. 1. The router plate 10 is comprised of a flat plate member 16 having a top side 18, a bottom side 20, and an opening 22 extending therethrough. The flat plate member 16 is mounted to the planar mounting surface 12 by screws 24 inserted through holes 26 in the flat plate member and received in holes 28 of the planar mounting surface 12. The flat plate member 16 is mounted such that the opening 22 is aligned with the arbor 30 of the router 14.

Figure 3:
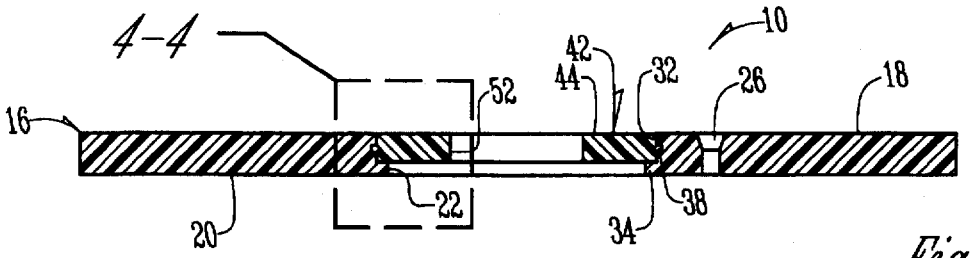
FIG. 3 is a sectional view taken along line 3—3 of FIG. 2.
Figure 2:
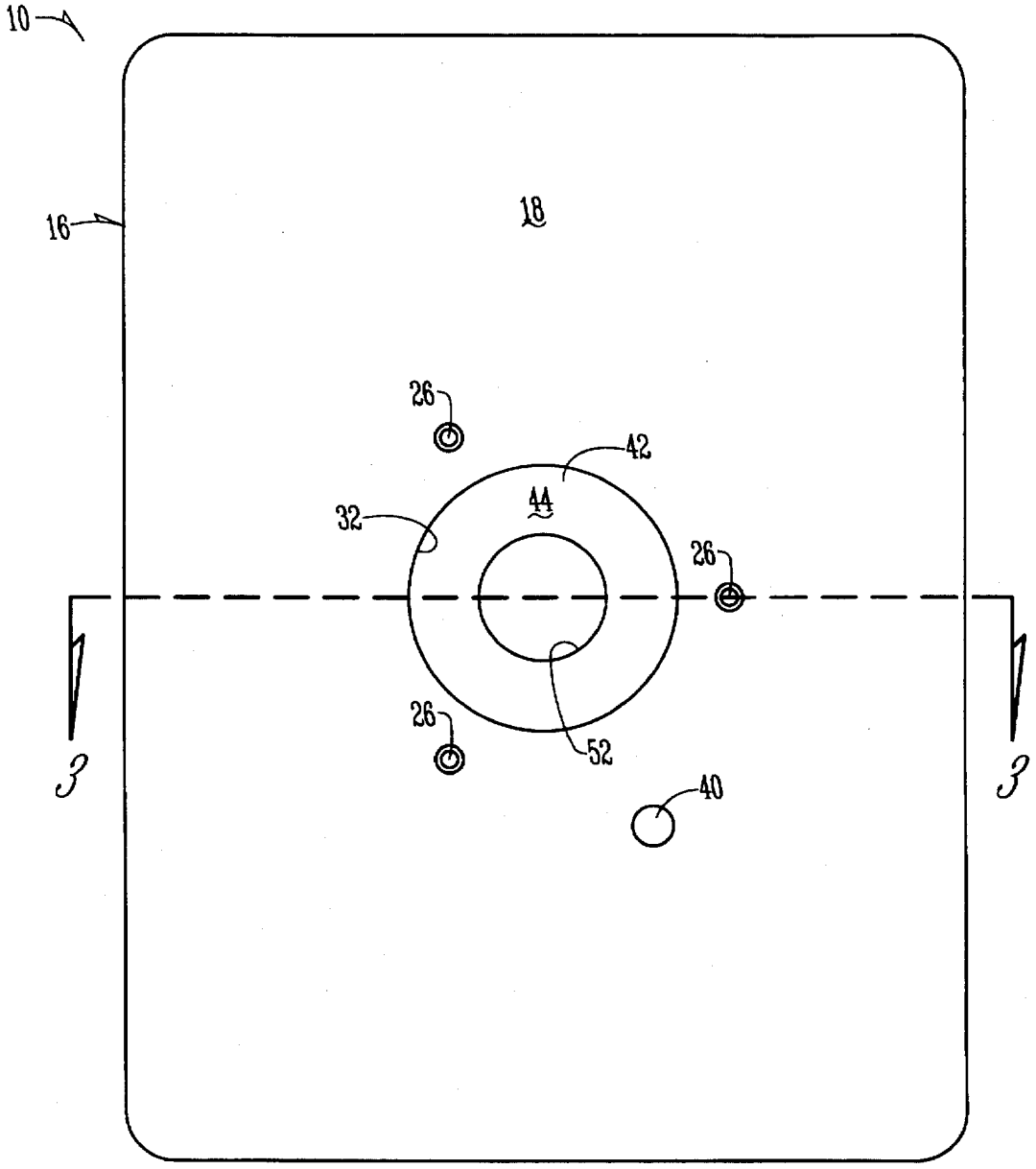
FIG. 2 is a top elevational view of the router plate of the present invention.
Figure 4:
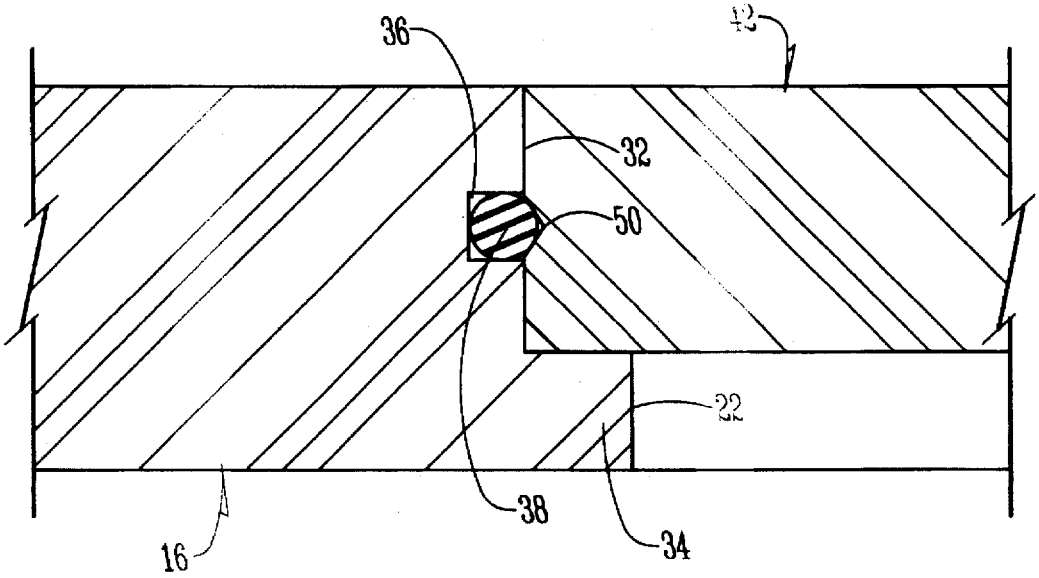
FIG. 4 is an enlarged sectional view of area 4—4 of FIG. 3.

The opening 22 of the flat plate member 16 as shown in FIGS. 1, 3 and 4 will now be described in more detail. The opening 22 is defined by its generally circular outer perimetric edge 32. A rabbet flange 34 extends inwardly from the outer perimetric edge 32 adjacent the bottom side 20 of the flat plate member 16. A slot 36 is formed along the outer perimetric edge 32 between the rabbet flange 34 and the top surface 18 of the flat plate member 16. Partially disposed within the slot 36 is an elastomeric O-ring 38 (see FIG. 4) which also extends inwardly from the outer perimetric edge 32.

A pin 40 is provided on and extends from the top side 18 of the flat plate member 16. The pin 40 is used to guide the work piece (not shown) during the cutting and detailing operations.

A removable insert 42 is also provided with the present invention. The removable insert 42 has a top surface 44, a bottom surface 46, and a side edge 48 therebetween. The side edge 48 includes a V-groove 50. When the removable insert 42 is disposed within the opening 22, the bottom surface 46 of the removable insert 42 abuts and is supported by the rabbet flange 34. As best shown in FIG. 4, the V-grove 50 in the side edge 48 of the insert 42 receives the elastomeric O-ring 38. Once positioned within the opening 22, the top surface 44 of the removable insert 42 conforms to and is flush with the top side 18 of the flat plate member 16.

The removable insert 42 also includes an aperture 52 for receiving a router bit (not shown) mounted atop the arbor 30. The router bit projects through the aperature 52 to cut and detail the work piece. The router plate 10 of the present invention is designed for use with router bits of different size. A plurality of removable inserts 42 can be provided, each having a different aperture size. Depending upon the specific application, the operator can quickly and easily select and detachably mount a removable insert 42 with an appropriately sized aperture 52.

Inserting and removing a particular removable insert 42 is quick and easy. The removable insert 42 is inserted into the opening 22 with the bottom surface 46 of the insert abutting the rabbet flange 34. Next, the top surface 44 of the insert 42 is forced downwardly so that the top surface 44 is flush with the top side 18 of the flat plate member 16 and the elastomeric O-ring 38 rides within the V-grove 50 in the insert. This means of detachably securing the removable insert 42 firmly holds the insert in place without the use of special tools or fasteners. To remove the insert 42, the bottom surface 46 is pushed upwardly until the insert becomes dislodged from the grip of the O-ring 38.

It can therefore be seen that the invention accomplishes at least all of its stated objectives.

What is claimed is:

1. A router plate for use with a router having a planar surface and an arbor projecting from said planar surface, said router plate comprising:

a flat plate member having an opening extending therethrough, said opening having first and second axial ends and circular outer perimetric edges, an enlarged portion of said opening being adjacent said first axial end, a rabbet flange extending inwardly from said outer perimetric edges adjacent said second axial end; and a raised O-ring disposed between said first axial end and said rabbet flange.

2. The router plate of claim 1 wherein said O-ring being formed of an elastomeric material.

3. The router plate of claim 1 further comprising a removable insert having a top surface, a bottom surface, and a side edge between said top and bottom surfaces, said insert being disposed within said opening with said bottom surface being supported by said rabbet flange and said side edge having a grove for receiving said O-ring.

4. The router plate of claim 3 wherein said removable insert having an aperture extending between said top and bottom surfaces for receiving said arbor therethrough.

5. The router plate of claim 4 wherein said aperture being circular about said top and bottom surfaces.

6. A method of detachably securing one of a plurality of removable inserts to a router plate for use with a router having a planar surface and a router bit mounted on an arbor projecting from said planar surface, said router plate having a flat plate member with an opening extending therethrough, said opening having first and second axial ends and circular outer perimetric edges, an enlarged portion of said opening being adjacent said first axial end, a rabbet flange extending inwardly from said outer perimetric edges adjacent said second axial end, an O-ring disposed between said first axial end and said rabbet flange, each of said inserts having a top surface, a bottom surface, and a side edge with a grove between said top and bottom surfaces, said method comprising the steps of: inserting one of said removable inserts into said opening; said bottom surface of said insert being supported by said rabbet flange and said grove receiving said O-ring.

7. The method of claim 6 wherein at least one of said removable inserts having an aperture extending between said top and bottom surfaces, said method further comprising the step of selecting the particular one of said inserts having said aperture sized to accept said bit.

8. A woodworking apparatus for use with a router having a planar mounting surface and an arbor projecting from said planar mounting surface comprising:

a router plate mounted on top of said planar mounting surface, said router plate having an opening extending therethrough, said opening having first and second axial ends and circular outer perimetric edges, an enlarged portion of said opening being adjacent said first axial end, a rabbet flange extending inwardly from said outer perimetric edges adjacent said second axial end;

a removable insert having a top surface, a bottom surface, and a side edge between said top and bottom surfaces, said insert being disposed within said opening with said bottom surface being supported by said rabbet flange; and an O-ring being disposed between said outer perimetric edges of said router plate and said side edge of said insert.

9. The woodworking apparatus of claim 8 wherein router plate having a ridge on said outer perimetric edges said side edge of said removable insert having a grove for receiving said O-ring.

10. The woodworking apparatus of claim 8 wherein said removable insert having an aperture extending between said top and bottom surfaces for receiving said arbor therethrough.

11. The woodworking apparatus of claim 10 further comprising a router bit mounted on said arbor, said aperture of said removable insert being sized to accept said bit.

12. The woodworking apparatus of claim 8 wherein said O-ring being elastomeric.

* * * * *